US007658968B2

(12) United States Patent
Otter

(10) Patent No.: US 7,658,968 B2
(45) Date of Patent: Feb. 9, 2010

(54) METHOD FOR MAKING A FILM WITH IMPROVED WETTABILITY PROPERTIES

(75) Inventor: Jim Otter, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 170 days.

(21) Appl. No.: 09/738,591

(22) Filed: Dec. 15, 2000

(65) Prior Publication Data

US 2002/0074110 A1 Jun. 20, 2002

(51) Int. Cl.
*B05D 1/12* (2006.01)
*B05D 3/12* (2006.01)

(52) U.S. Cl. ..... 427/204; 427/203; 427/359

(58) Field of Classification Search ..... 427/180, 427/202–205, 212–222, 7; 63/2, 32; 428/546, 428/559, 612, 402, 916
See application file for complete search history.

(56) References Cited

U.S. PATENT DOCUMENTS 2,899,288 A * 8/1959 Barclay ..... 51/293
2,936,814 A * 5/1960 Yakubik
3,450,585 A * 6/1969 Takagi et al. ..... 156/242
3,813,231 A * 5/1974 Gilbert ..... 51/298
3,973,510 A * 8/1976 McCulloch et al. ..... 114/67 A
4,181,773 A * 1/1980 Rickert, Jr. ..... 428/329
4,421,789 A * 12/1983 Kaneko et al. ..... 427/204
4,738,307 A 4/1988 Bentley
4,807,588 A 2/1989 Bentley et al.
4,848,314 A * 7/1989 Bentley ..... 126/116 R
4,921,646 A * 5/1990 Stewart ..... 264/475
4,947,548 A 8/1990 Bentley
5,245,100 A * 9/1993 Hommeltoft et al. ..... 585/720
5,264,250 A * 11/1993 Steele et al. ..... 427/380
5,571,614 A 11/1996 Harrison et al.
5,656,222 A 8/1997 Berry et al.
5,728,424 A * 3/1998 Walling ..... 427/180
5,916,635 A * 6/1999 Ishii et al.
6,013,372 A * 1/2000 Hayakawa et al. ..... 428/411.1
6,132,801 A * 10/2000 Linford ..... 427/221

OTHER PUBLICATIONS

Deng, C.-S., et al., Nucleation and Growth of Gas Barrier Aluminum Oxide on Surfaces of Ploy(ethylene terephthalate) and Polypropylene: Effects of the Polymer Surface Properties, 2000, Journal of Polymer Science, John Wiley & Sons.

* cited by examiner

*Primary Examiner*—Frederick J Parker
(74) *Attorney, Agent, or Firm*—Carlson, Gaskey & Olds P.C.

(57) ABSTRACT

A method for making a film having improved wettability properties for use with a heat exchanger of a condensing furnace or an air conditioner. The film can be made of any thermoplastic film which bonds to metal. Polar particulates are mechanically are adhered to and embedded in the upper surface of the heated film. The particulate can be surface treated to either enhance adhesion of the particulate to the film or to enhance wettability. In another embodiment, the film is coated with an adhesive substance or a mixture of reactants, the particulate pressed into and adhered to the coating.

5 Claims, 5 Drawing Sheets

METHOD FOR MAKING A FILM WITH IMPROVED WETTABILITY PROPERTIES

BACKGROUND OF THE INVENTION

The present invention relates generally to a method for making a film with a higher surface energy having improved wettability properties.

Condensing heat exchangers are employed in condensing furnaces to increase efficiency. The condensing heat exchanger cools the heating fluid to a temperature below the dew point. As the temperature drops below the dew point, a liquid condensate, water vapor, condenses from the heating fluid. As the liquid condensate condenses, heat is transferred from the water vapor to the air to be heated. As more heat is produced, the efficiency of the system is increased.

Polypropylene films are used to make laminated heat exchanger material. Most films have surface energies (30-40 dynes) that are considerably lower than the surface energy of water (78 dynes). Because the films have a considerably lower surface energy, the liquid condensate forms as droplets on the surface of the film, rather than spreading out as a thin film. The droplets can leave the film and enter the atmosphere. As the liquid condensate is slightly acidic, the formation of droplets is environmentally undesirable.

Liquid condensate also forms as droplets on air conditioner evaporator heat exchanger fin stock. The film applied to the aluminum fin is also of low surface energy. As air flows, the liquid condensate droplets can leave the surface of the film and enter the area which is to be cooled. Additionally, the droplets can increase the likelihood of corrosion of the fins.

Hence, there is a need in the art for a method for making a film with a higher surface energy having improved wettability properties.

SUMMARY OF THE INVENTION

The present invention relates to a method for making a film with a higher surface energy having improved wettability properties.

By increasing the surface energy of the film, the wettability of the film can be increased, improving heat transfer. The film can be made of any thermoplastic film which bonds to metal, such as polyolefin, polyester, polyetherketone, polyetheretherketone, polysulfone, polyethersulfone, polytetrafluoroethlyne, or fluorinatedhydrocarbon.

While the film is soft and heated, polar particulates are mechanically adhered to and embedded in the upper surface of the film. The particulate may be any polar material that embeds in and adheres to the upper surface of the film. The particulate is partially exposed and creates a polar surface. The polar particulate may be alumina, silica, zirconia, wollastonite, talc, titanium dioxide, or any other polar material. At the molecular level, the polar particulate is charged and has a positive portion and a negative portion. The positive portion and the negative portion of the polar particulates attract the polar water molecules which are also charged at the molecular level.

The metal surface of the heat exchanger is then coated with either an adhesive substance or a mixture of reactants that polymerize in situ. The cooled film is then laminated to the metal surface of the heat exchanger.

In another embodiment, the particulate is surface treated to either enhance adhesion of the particulate to the polymer or to enhance wettability.

In another embodiment, the particulate is pressed into a film coated with either an adhesive substance or a mixture of reactants that polymerize in situ.

Accordingly, the present invention provides a method for making a film with a higher surface energy having improved wettability properties.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
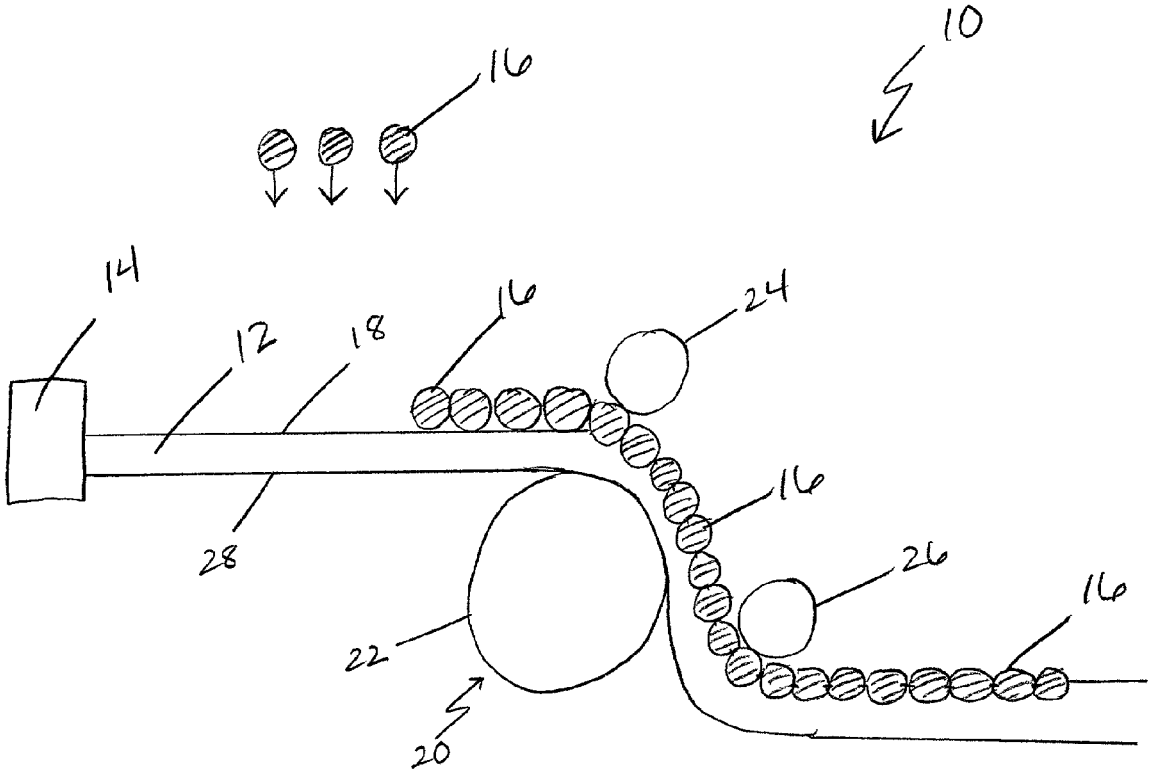
FIG. 1 illustrates a schematic diagram of an apparatus for making the film of the present invention.
Figure 2:
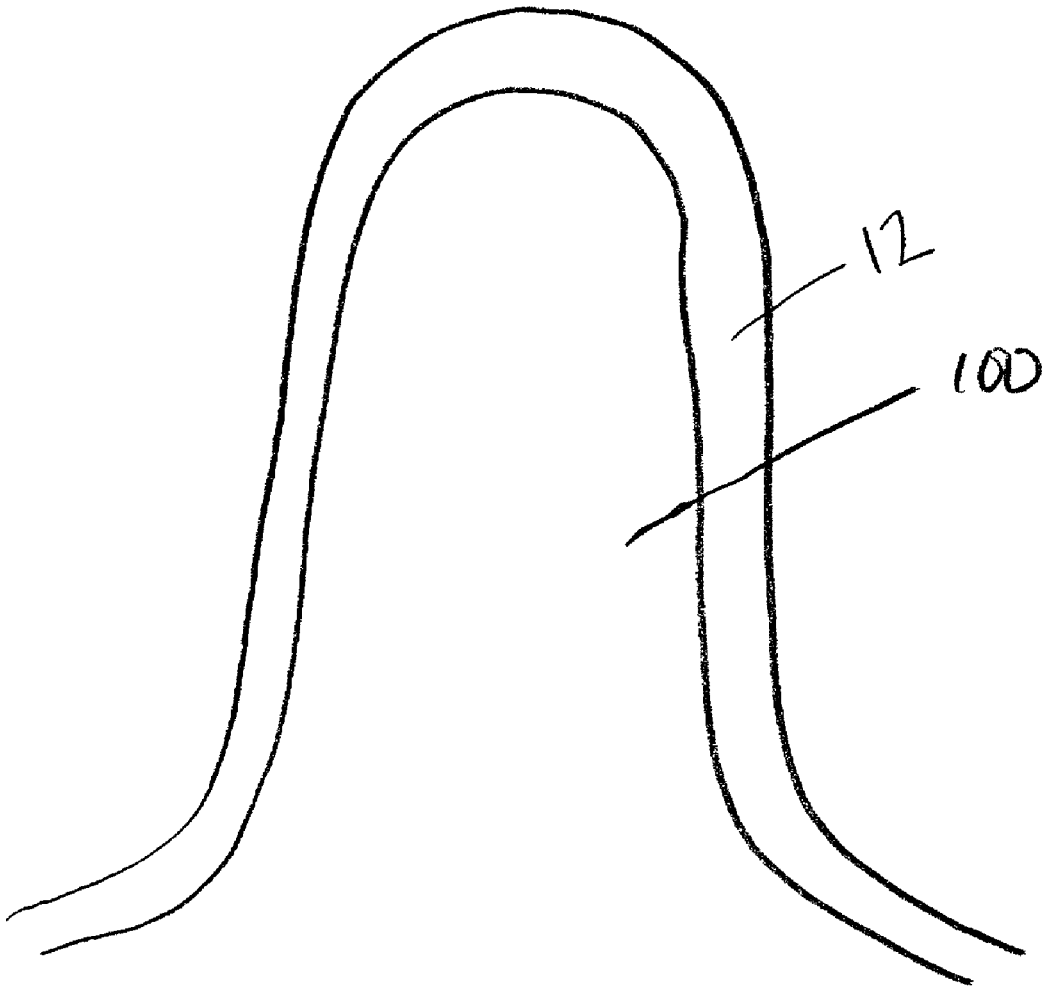
FIG. 2 illustrates a film employed on a heat transfer component.

Referring now to FIG. 1, an apparatus 10 for making a film 12 with improved wettability is illustrated. The film 12 is laminated to the metal heat exchanger of either a condensing furnace or an aluminum fin of an air conditioner evaporator shown schematically at 100 in FIG. 2. The metal heat exchanger 100 cools the fluid to a temperature below the dew point. As the temperature drops below the dew point, a liquid condensate, water vapor, condenses, transferring heat from the water vapor to the air.

By increasing the surface energy of the film 12, the wettability of the film 12 can be increased and heat transfer can be improved.

The heated film 12 is extruded from a die 14. The film 12 can be made of polyolefin, polyester, polyetherketone, polyetheretherketone, polysulfone, polyethersulfone, polytetrafluoroethlyne, or fluorinatedhydrocarbon. However, any thermoplastic film 12 which bonds or can be bonded to metal can be utilized.

While the film 12 is soft and heated, a polar particulate 16 is mechanically added to the upper surface 18 of the film 12. The film 12 enters a roller assembly 20 which embeds and adheres the particulate 16 to the upper surface 18 of the film 12. As the film 12 begins to pass over a large roller 22, a first small roller 24 positioned over the large roller 22 presses the particulate 16 into the upper surface 18 of the film 12. The temperature of the first smaller roller 24 is controlled to prevent the film 12 from cooling too fast.

As the film 12 continues to pass over the large roller 22, the film 12 begins to cool. A second small roller 26 is positioned proximate to the large roller to retain the film 12 against the large roller as the film 12 cools. The temperature of the large roller is also controlled to insure that the film 12 has "set" when the film 12 leaves the roller assembly 20.

The particulate 16 may be any polar material that embeds in and adheres to the upper surface 18 of the film 12. The particulate 16 is partially exposed to create a polar surface on the upper surface 18 of the film 12. The particulate 16 may be alumina, silica, zirconia, wollastonite, talc, titanium dioxide, or any other polar material.

At the molecular level, the polar particulate 16 is slightly charged and includes a positive ion and a negative ion. The condensed water vapor of the liquid condensate is also polar and includes a positive hydrogen ion and a negative hydroxide ion. The positive ion and the negative ion of the polar particulate 16 attracts the polar water molecules. For example, if the particulate 16 is titanium dioxide, the particulate molecule contains a positive titanium ion and two negative oxide ions. The positive titanium ion attracts the negative hydroxide ion of the condensate water vapor and the negative oxide ions attract the positive hydrogen ion of the condensate water vapor.

If titanium dioxide is utilized as the particulate 16, it can also be employed as a germicide. As ultraviolet light contacts the titanium dioxide particulate, ozone is produced. The ozone kills bacteria, improving indoor air quality.

Figure 3:
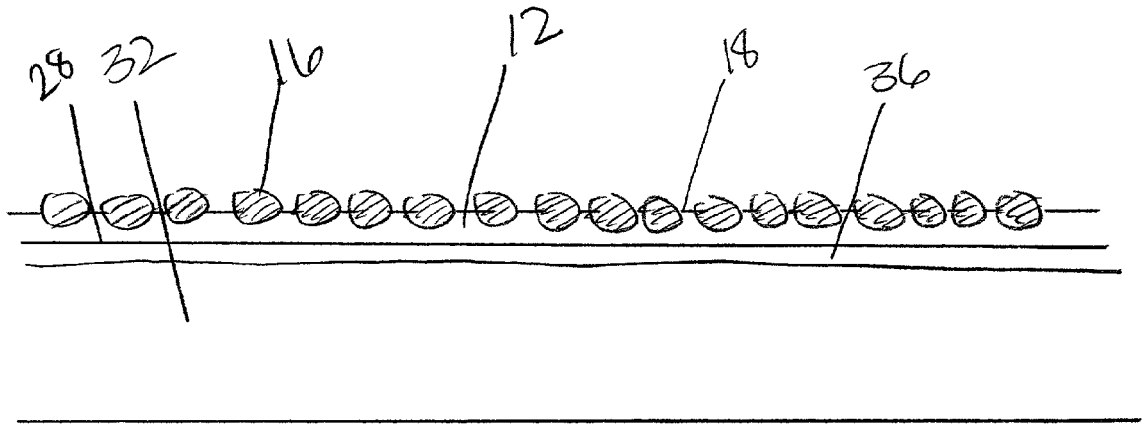
FIG. 3 illustrates the particulate embedded in and adhered to the film.

As illustrated in FIG. 3, after the particulate 16 is embedded in and adhered to the upper surface 18 of the film 12 and the film 12 cools, the lower surface 28 of the film 12 is attached to the metal surface 32 of a heat transfer component. The component could be a fin, a heat exchanger, or other heat transfer component. The film 12 is attached to the metal surface 32 by either an adhesive surface or a mixture of reactants 36 that polymerize in situ.

The embedded and adhered polar particulate 16 increases the surface energy and the wettability of the film 12, allowing the liquid condensate to form as a layer rather than as droplets, which can be easily spread into the atmosphere.

Figure 4:
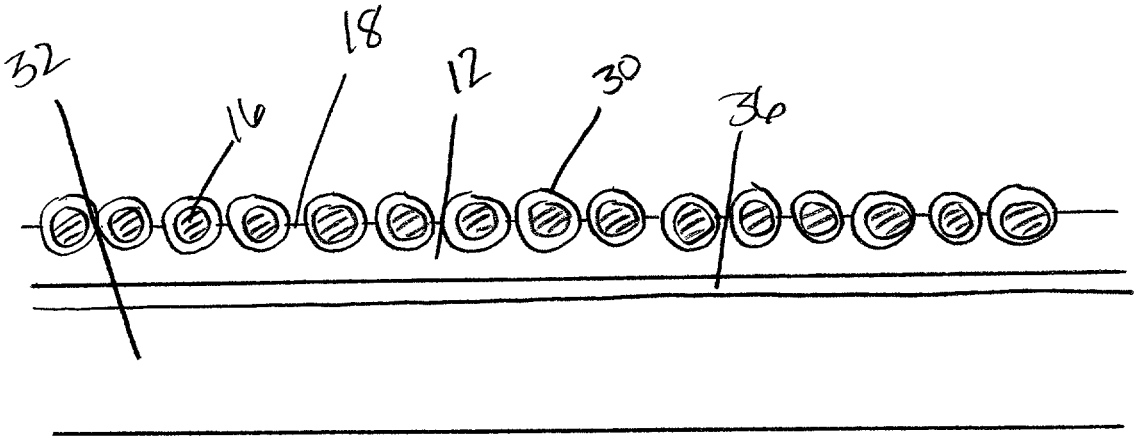
FIG. 4 illustrates the surface treated particulate embedded in and adhered to a film.

In another embodiment, as shown in FIG. 4, a surface treatment 30 is added to the particulate 16 either to enhance adhesion of the particulate 16 to the polymer or to enhance wettability. Any surface treatment 30 can be utilized to enhance adhesion or wettability. If the film 12 is made of polyester, malcic anhydride can be utilized as the surface treatment 30. The surface treatment 30 utilized on the particulate 16 varies depending on the chemistry of the film 12.

Figure 5:
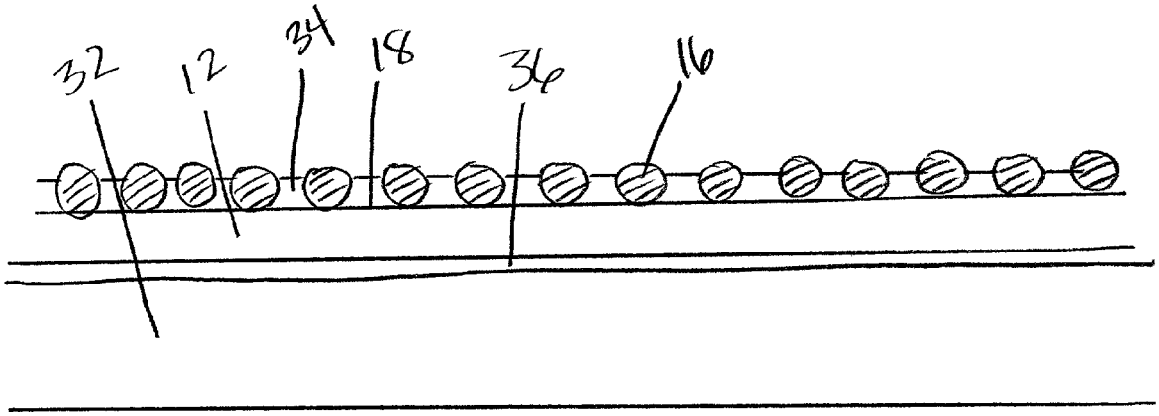
FIG. 5 illustrates the particulate adhered to the film by an adhesive substance or a mixture of reactants.

In another embodiment, as illustrated in FIG. 5, the particulate 16 is adhered to the film 12 by a coating 34 of an adhesive substance or a mixture of reactants that polymerize in situ. The particulate 16 is pressed into and embedded into the coating 34 before curing.

By adhering polar particulates to a film laminated on the metal surface of a heat exchanger, a polar surface is formed. The polar surface increases the surface energy of the film and improves wettability. As liquid condensate forms in the heat exchanger, the liquid condensate spreads over the polar surface of the film rather than forming droplets which can spread into the atmosphere.

It is preferred that the extruded film 12 have a thickness between 0.1 mil and 10mils, or between 2.54 microns and 254 microns. It is also preferred that the polar particulate 16 have a size range between 0.25 microns and 100 microns. However, the size of the polar particulate 16 must correspond to the thickness of the film 12. If the polar particulate 16 is too large for the thickness of the film 12, the particulate 16 will not adhere to the film 12. However, if the polar particulate 16 is too small for the thickness of the film 12, the particulate 16 will become embedded into the film 12 and the polar surface will not protrude from the film 12. The size of the particulate 16 also depends on the fluidity of the film 12 and the amount of pressure placed on the particulate 16 to adhere and embed the particulate into the film 12.

The amount of particulate added to the surface of the film 12 also depends on the surface energy required. If the surface area is not required to be high, less particulate is needed. If the surface area is required to be high, more particulate is needed. If more particulate is added, the surface tension of the film can be increased. Therefore, the average surface energy of the film can be controlled by the number of particulates per the area of the film.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A method for making a film for use with a heat transfer component comprising the steps of:

coating an outer surface of a plurality of polar particulates with maleic anhydride;

applying the plurality of polar particulates to the film;

adhering the plurality of polar particulates to the film; and adding the film to the heat transfer component.

2. The method as recited in claim 1 wherein the film is thermoplastic.

3. The method as recited in claim 1 wherein the film is one of polyolefin, polyester, polyetherketon, polyetheretherketone, polysulfone, polyethersulfone, polytetrafluoroethylene and fluorinatedhydrocarbon.

4. The method as recited in claim 1 wherein the plurality of particles are silica.

5. A method for making a film for use with a heat transfer component comprising the steps of:

applying a plurality of polar particulates to a surface of a heated film;

then embedding the plurality of polar particulates into the surface of the heated film with a roller;

regulating a temperature of the roller to regulate a temperature of the film;

then adding the film to the heat transfer component; and coating an outer surface of the plurality of polar particulates with a coating, wherein the film is made of polyester and the coating is maleic anhydride.

* * * * *

UNITED STATES PATENT AND TRADEMARK OFFICE

CERTIFICATE OF CORRECTION

PATENT NO. : 7,658,968 B2
APPLICATION NO. : 09/738591
DATED : February 9, 2010
INVENTOR(S) : Jim Otter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Twenty-eighth Day of December, 2010

David J. Kappos

David J. Kappos
*Director of the United States Patent and Trademark Office*